United States Patent [19]

Walsh

[11] Patent Number: 4,742,867

[45] Date of Patent: May 10, 1988

[54] METHOD AND APPARATUSES FOR HEAT TRANSFER

[75] Inventor: Myles A. Walsh, Falmouth, Mass.

[73] Assignee: Cape Cod Research, Inc., Buzzards Bay, Mass.

[21] Appl. No.: 936,152

[22] Filed: Dec. 1, 1986

[51] Int. Cl.[4] ..... F28F 13/00
[52] U.S. Cl. ..... 165/96; 165/185
[58] Field of Search ..... 165/96, 185

[56] References Cited

U.S. PATENT DOCUMENTS 3,706,127 12/1972 Oktay et al. ..... 165/911
3,763,928 10/1973 Derr ..... 165/96

FOREIGN PATENT DOCUMENTS 1160384 6/1985 U.S.S.R. ..... 165/96

*Primary Examiner*—Albert W. Davis, Jr.
*Attorney, Agent, or Firm*—Lorusso & Loud

[57] ABSTRACT

A system for controlling the flow of thermal flux including a heat source and a heat sink being in proximity to each other and an electrochemically variable thermal switch to control transfer of heat therebetween.

5 Claims, 1 Drawing Sheet

METHOD AND APPARATUSES FOR HEAT TRANSFER

BACKGROUND OF THE INVENTION

The present invention relates generally to a method and apparatuses for the change of thermal flow between thermal heat sources and thermal heat sinks. The method involves the electrochemical formation and removal of tree-like crystals or dendrites within structures through which heat is passing.

There are many examples in the prior art of heat transfer switches which typically comprise elements which mechanically provide for changes in thermal conduction between the heat source and sink. Typically these devices control the heat flux through mechanical variations of a gap between the source and the sink. This gap typically contains a liquid or gas whose primary function is to provide a path for conductive heat transfer.

Very large changes in heat transfer are possible when metal-metal contact replaces a gap filled with an insulating medium. However, the prior art of heat transfer switches involves the use of very complicated mechanisms which do not lend themselves to fabrication into flexible foils or films. Thus their use has been largely limited to controlling the heat management in man-made space vehicles.

There are examples in the prior art of thin flexible surfaces designed to control transfer of heat perpendicular to the surface. These examples, however, achieve only very modest variations in heat transfer. In the U.S. Pat. No. 4,515,206, to Carr, active regulation of heat transfer is achieved by placing liquid crystal material between thin foils of metal. By applying a strong electric field between the enclosing foils, changes in the orientation of the liquid crystal result. These changes in orientation produce changes in the thermal conductivity between the foils. Unfortunately these effects tend to be very small even for large applied fields and require the continuous application of electrical power.

SUMMARY OF THE INVENTION

According to the present invention there is provided a method and apparatuses for actively controlling heat transfer between a source of and a sink for heat. The novel method involves electrochemically converting ionic materials to metal dendrites which bridge gaps between opposing conductive regions. These metal bridges increase the thermal conductivity between said regions. By way of example, but not by way of limitation, this is accomplished by surrounding ionic material with foils or grids of electrically conductive material. This arrangement is similar to that found in all electric storage batteries and is not novel. However, the formation and growth of dendrites present a serious problem in secondary batteries; thus, the composition of the electrolyte and the geometry of the electrodes are carefully chosen so as to prevent dendrite growth.

In the thermal heat switches of this invention said ionic materials as well as the geometry of said foils or grids are chosen so as to encourage the formation during charge of metal dendrites. Preferred geometries and ionic materials are those which encourage formation during charge of dendritic deposits of metal. Said dendrites extend from the surface of the foils and form metal paths from one foil to the other. Since metals have thermal conductivities more than 100 times those of ionic materials, changing even small amounts of ionic materials into thermally conductive metal paths makes very substantial changes in the thermal conductivity between the foils.

For the very simplest geometries and choices of materials only one closing of the thermal switch of this invention is possible. This is because, once formed within this simple geometry, the metal dendrites are difficult to remove. It has, however, suprisingly been found that certain choices of geometry allow the cyclic use over long periods of time of the apparatus. In these geometries electrical modulation of conductive heat transfer is achieved. Electroplating metal dendrites increases heat transfer; reversing the current direction removes the dendrites and thereby decreases heat transfer.

The apparatuses of said invention are especially useful for controlling the operating temperatures of electronic component packages. The electrical rather than mechanical nature of the invention lends itself to simple, reliable and economical control of component temperature. Techniques are well known for electrical temperature sensing of the source and/or sink temperatures followed by the passage of electric currents to make the desired changes in the thermal conductivity of the invention in order to effect the desired changes in the operating temperature of the electronic component.

BRIEF DESCRIPTION OF THE DRAWING

A more complete understanding of the invention and many attendant advantages thereof will be readily appreciated as the same becomes better understood by reference to the following detailed description when considered in connection with the accompanying drawing wherein.

DESCRIPTION OF THE PREFERRED EMBODIMENT

Figure 1:
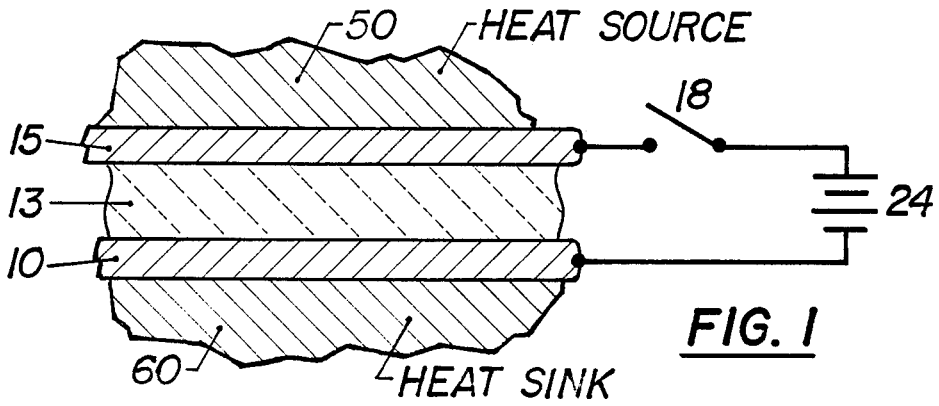
FIG. 1 is a cross sectional view of the apparatus in its simplest form.

Referring to FIG. 1, an ionically conductive region 13 is situated between two electrically and thermally conductive surfaces, 10 and 15. Although said region 13 could comprise inorganic gels of various salts, liquids and inert fillers, ionomers are generally preferred for those applications which demand solid flexible structures for the electrical modulation of conductive heat transfer. Ionomers are polymers which contain bound ionic sites and mobile counter ions. There are numerous practical examples with ionic conductivities of about 0.1 mho/cm and thermal conductivities of less than 1 W/m-°C. Varying the degree of crosslinking between ionomers permits variation of their physical properties from gels all the way to materials which are difficult to mechanically penetrate. They may be formed according to the traditional procedures of the art, as described in Eisenberg, A., Ions in Polymers (1980), Advances in Chemistry Series 187, American Chemical Society, Washington, D. C. Of these, the salts and acids of ionomer systems based on ethylene, styrene, tetrafluoroethylene or carboxylated-phenylated polyphenylenes are preferred for their good thermal and chemical stability, for their ability to form thin films, for their good mechanical strength, and for their ability to form materials with good ionic conductivity but poor thermal conductivity. By way of example, but not by way of limitation, preierred ionomers include the acids and salts of poly(4-styrene sulfonate), poly(tetrafluoro sulfonate), and carboxylated-phenylated polyphenylenes.

Figure 2:
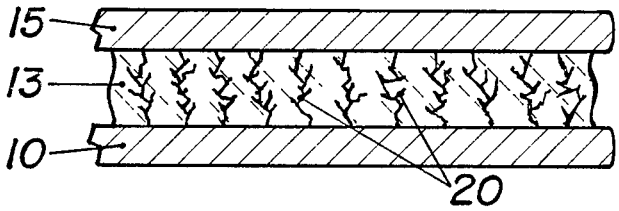
FIG. 2 is a cross sectional view of the apparatus in FIG. 1 after dendrites 20 have been electrochemically grown by passing an electric current between electrically and thermally conductive regions 10 and 15 by closing switch 18 for a sufficient period of time to cause electroplating of said dendrites 20 by passage of an electric current from battery 24.

When an electric current is applied to the conductive surfaces, 10 and 15, tree-like structures grow from the negative electrode 10 towards the positive electrode 15. Another embodiment of the invention involves apparatuses where the region 13 in FIG. 1 between surfaces 10 and 15 comprises an intimate mixture of ionically conductive material and ionically insulating material. Including thermally insulating material in region 13 by mechanically mixing spheres, blacks, fibers or powders into the ionomer prior to formation of 15 not only raises the thermal resistance of the apparatus but tends to produce nonuniformities in the electric fields between regions 10 and 15 during the passage of ionic current between them. Said nonuniformities result in uneven electroplating on the inner surfaces of region 10 and dendrites 20. Said dendrites 20 are illustrated in FIG. 2.

The dendrites 20 may be formed from any metal whose ions form salts with said ionomers. Zinc, copper and silver are particularly desirable because of the ease with which they form dendrites, for their high thermal conductivity, and for the reversible nature of their electroplating.

Metal foils are preferred as the electrically conductive and thermally conductive surfaces 10 and 15. The metal foil may, but need not, serve as the source of metal ions for the electrochemical production of dendrites. For thermal switches with limited cycle life metal foils of the same material as the dendrites are preferred. These simple switches are illustrated in FIGS. 1 and 2. In these apparatuses passage of electric current from surfaces 15 to 10 causes dendrites 20 to grow from the surface connected to the negative side of DC voltage source 23. The dendrites 20 physically penetrate region 13 and thereby reduce the gap between the heat transfer elements. For those apparatuses in which the material to form the dendrite ultimately comes from the electrochemical corrosion of the surface 15 it is desirable for mechanical reasons to laminate the outside of said surface 15 with thermally conductive but electrochemically passive material. Suitable materials include titanium foils or metals more noble than that used for the inner face of surface 15.

Figure 3:
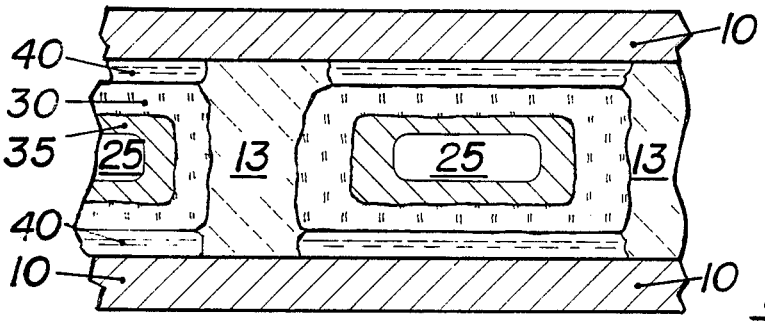
FIG. 3 is a cross sectional view of an apparatus designed to provide a large number of on-off cycles of the thermal switch.
Figure 4:
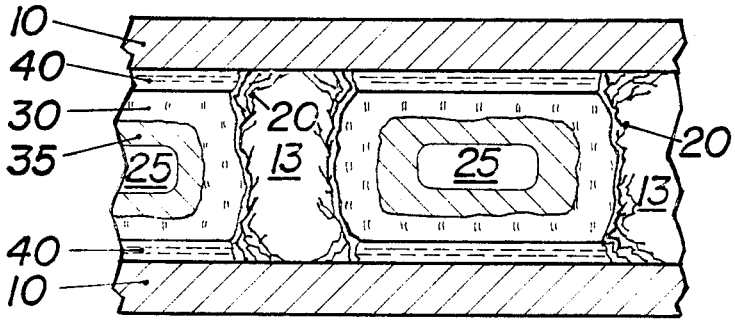
FIG. 4 is a cross sectional view of the apparatus in FIG. 3 after dendrites 20 have been electrochemically grown by passing an electric current between electrically and thermally conductive regions 10 and grid 25.

Referring to FIGS. 3 and 4, apparatuses containing insulated grids 25 provide for a larger range of control of heat transfer between the heat source and heat sink. They are preferred for those applications in which numerous cycles are desired. This arrangement is designed to cause dendrites 20 to grow from foils 10 along an interface between a tightly crosslinked ionomer 30 and a second ionomer 13. This is illustrated in FIG. 4. In this embodiment both outer surfaces of regions 10 of the apparatus are connected to the negative terminal of the current source and a coated grid 25 is connected to the positive terminal.

For apparatuses with large cycle life it is desirable to provide means for dendrite formation other than merely electrochemically corroding a portion of the composite structure. Said means are provided in FIGS. 3 and 4 by coating a grid 25 with electrochemically active material 35. Numerous formulations are available which combine chemical durability against aerial oxidation and moisture, fast electrochemical response, and sufficient reversibility for both oxidation and reduction. By way of example, but not by way of limitation, polyaniline electrochemically formed on expanded metal grids according to the procedures of Kitani et al., J. Electrochemical Society, Vol. 133, pp. 1069–1073, provides a coated grid capable of thousands of cycles.

For apparatuses with large cycle life the ionic material for forming dendrites is supplied by the ions dissolved in the ionomers. Since the coated grid 25 typically provides protons to the ionomer to replace the metal ions during the dendrite formation process, it is important that the dendrites be stable in an acidic environment. Otherwise undesirable hydrogen gas will result. Preierred metal ions are silver and copper.

The conductive regions 10 in FIGS. 3 and 4 are preferably stable in an acidic environment and their inner surfaces bond well with adhesive layer 40 to the heavily crosslinked ionomer 30. Preferred surfaces are made of titanium or graphite foil with thicknesses of less than 1 mm.

While only a limited number of embodiments of the present invention are disclosed and described herein, it will be readily apparent to persons skilled in the art that numerous changes and modifications may be made without departing from the scope of the invention. These include filling the ionomers with insulating materials so as to decrease the thermal conductivity of the apparatus when dendrites are not present. These also include filling the ionomers with graphite fibers or blacks in order to provide for paths along which dendrites can form. Accordingly, the foregoing disclosure and description thereof are for illustrative purposes only and do not in any way limit the invention which is defined only by the claims which follow.

What is claimed is:

1. A variable thermal switch with a means for controlling heat insulation comprising a surface adapted to face a source of heat, a second surface opposite said first surface and adapted to face a sink for heat, and means for electrochemically producing and removing dendrites positioned between said surfaces.

2. Apparatus according to claim 1 having in addition external electrical means for electrochemically producing and removing dendrites within said apparatus.

3. Apparatus according to claim 1 wherein said surfaces comprise foils of metal or graphite.

4. Apparatus according to claim 1 wherein said means for electrochemically producing and removing dendrites comprises ionomers containing at least one ion selected from the group consisting of hydrogen ions, metal ions and mixtures thereof.

5. A variable thermal switch with a means for controlling heat insulation comprising a surface adapted to face a source of heat, a second surface opposite said first surface and adapted to face a sink for heat, and means for electrochemically producing and removing dendrites positioned between said surfaces wherein said means for electrochemically producing and removing dendrites comprises a grid for conducting electric current and for supporting electroactive material.

* * * * *